US007958639B2

(12) United States Patent
Ireland

(10) Patent No.: US 7,958,639 B2
(45) Date of Patent: Jun. 14, 2011

(54) KNIFE

(75) Inventor: William Alfred Ireland, Churchdown (GB)

(73) Assignee: WA1 Designs Limited (GB)

( * ) Notice: Subject to any disclaimer, the term of this patent is extended or adjusted under 35 U.S.C. 154(b) by 129 days.

(21) Appl. No.: 11/129,946

(22) Filed: May 16, 2005

(65) Prior Publication Data

US 2006/0288587 A1 Dec. 28, 2006

(30) Foreign Application Priority Data

May 20, 2004 (GB) ..... 0411220.7

(51) Int. Cl.
*B26B 3/08* (2006.01)
*B26B 3/00* (2006.01)

(52) U.S. Cl. ..... 30/2; 30/287; 30/289; 30/294; 30/317

(58) Field of Classification Search ..... 30/2, 280, 30/294, 339, 314, 160–162, DIG. 3, 286, 30/289, 317; 7/160; D8/98–99, 102
See application file for complete search history.

(56) References Cited

U.S. PATENT DOCUMENTS

| | | | | | |
|---|---|---|---|---|---|
| 1,553,449 | A * | 9/1925 | Kennedy | 30/294 |
| 4,134,206 | A * | 1/1979 | Beermann | 30/294 |
| 4,833,956 | A * | 5/1989 | Roberts | 83/56 |
| D323,278 | S * | 1/1992 | Zwick | D8/98 |
| 5,561,905 | A * | 10/1996 | Sherman | 30/280 |
| 5,768,787 | A * | 6/1998 | Ireland | 30/294 |
| D401,492 | S * | 11/1998 | Joseph, Jr. | D8/98 |
| 5,829,321 | A | 11/1998 | Domenico | |
| 6,094,820 | A * | 8/2000 | Adachi | 30/30 |
| 6,691,416 | B2 * | 2/2004 | Yu Chen | 30/294 |
| 7,077,076 | B2 * | 7/2006 | Porter et al. | 119/625 |
| 2002/0026711 | A1 * | 3/2002 | Edwards et al. | 30/90.1 |
| 2002/0078572 | A1 * | 6/2002 | Linton et al. | 30/294 |
| 2005/0235500 | A1 * | 10/2005 | Domenico | 30/294 |
| 2005/0274026 | A1 * | 12/2005 | Lee | 30/294 |

FOREIGN PATENT DOCUMENTS

| | | | |
|---|---|---|---|
| DE | 20309701 | U1 * | 9/2003 |
| GB | 2 330 323 | | 4/1999 |
| WO | WO2004/041487 | | 5/2004 |

* cited by examiner

*Primary Examiner* — Laura M. Lee
(74) *Attorney, Agent, or Firm* — Skinner and Associates

(57) ABSTRACT

A knife includes a knife body defining a channel across which extends at least part of the cutting edge of a blade. The channel having has a base region located behind the cutting edge in the cutting direction. The knife body is provided, adjacent the base region, with flow passages on opposing sides thereof, the flow passages being out of alignment with one another.

4 Claims, 2 Drawing Sheets

KNIFE

This invention relates to a knife, and in particular to a knife of the type in which a guard is provided to restrict access to a blade thereof.

Where knives with exposed blades are used, for example, to open bags, sacks or other forms of packaging, there is a risk that the user of the knife may accidentally cut or prick himself. Obviously such accidents should be avoided where possible. Further, where the knife is used by an employee in the course of his employment, there may be occasions where the employer has a duty to make the workplace as safe as possible and this may prevent the use of knives having open, unguarded blades.

One type of knife having a guarded blade comprises a knife body having a narrow channel formed therein across which a cutting edge of a blade extends, the narrow channel being sufficiently small to prevent the user's fingers for accessing the cutting edge of the blade.

Behind the cutting edge of the blade, at the base of the channel, ramped surfaces are provided.

When cutting relatively flexible materials, the knife functions well. However, when cutting less flexible materials, for example stiff card, the newly cut material is insufficiently flexible to ride up and over the ramped surfaces. This can lead to difficulties being faced in cutting such materials.

According to the present invention there is provided a knife comprising a knife body defining a channel across which extends at least part of the cutting edge of a blade, the channel having a base region located behind the cutting edge in the cutting direction, the knife body being provided, adjacent the base region, with flow passages on opposing sides thereof, the flow passages being out of alignment with one another.

The flow passages may be in the form of ramped surfaces.

By arranging for the ramped surfaces to be out of alignment with one another, the cut material is urged apart thereby assisting in allowing continued movement of the knife.

The ramped surfaces are conveniently of relatively shallow angle, and thus are relatively long. Conveniently, the ramped surfaces are ramped both in the longitudinal direction thereof, and in a transverse direction, the ramping in the transverse direction being of a steeper angle.

The invention will further be described, by way of example, with reference to the accompanying drawings, in which.

Figure 1:
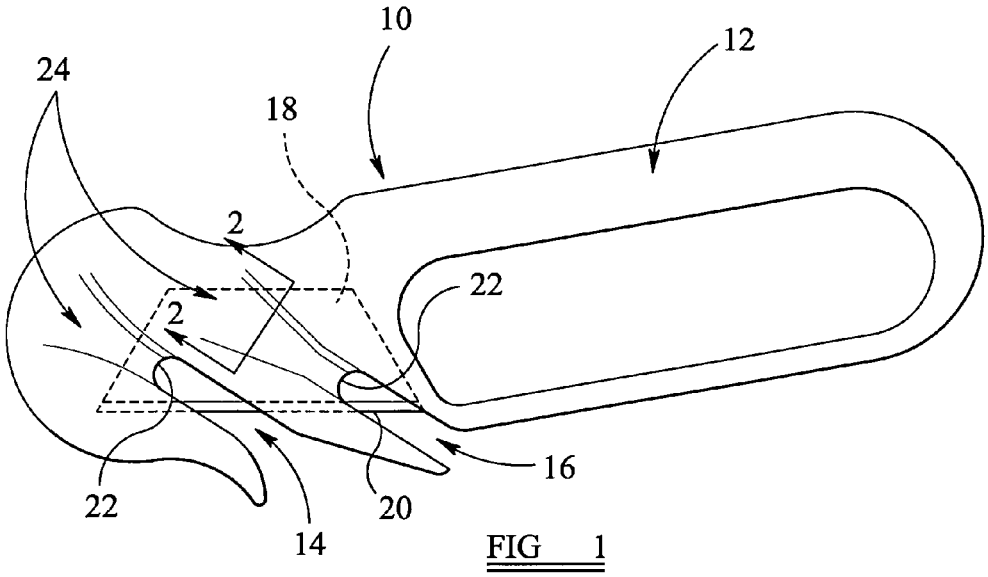
FIG. 1 is a plan view illustrating a knife in accordance with an embodiment of the invention.
Figure 2:
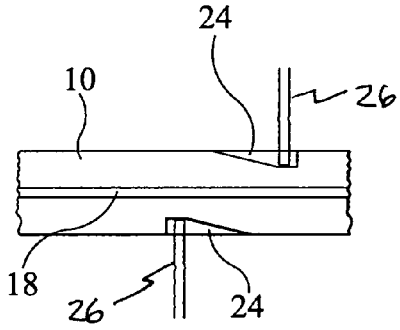
FIG. 2 is a diagrammatic cross-sectional view illustrating part of the knife of FIG. 1.

FIGS. 1 and 2 of the accompanying drawings illustrate a safety knife in accordance with an embodiment of the invention which comprises a knife body 10 shaped to define a loop handle region 12 adapted to be gripped by a user. The body 10 further defines a pair of narrow channels 14, 16, the knife body 10 housing a blade 18, the cutting edge 20 of which extends across the channels 14, 16. The widths of the channels 14, 16 are chosen so as to be sufficiently small that a user's finger or similar sized object cannot fit into the channels 14, 16 or the distance into the channels 14, 16 to which such objects can be inserted is insufficient to bring the objects into contact with the cutting edge 20 thereby reducing risk of injury to a user of the knife.

Each of the channels 14, 16 includes a base region 22 located behind the cutting edge 20 of the blade 18, in the cutting direction of the knife.

The parts of the knife body 10 adjacent the base regions 22 are shaped to define flow passages through which the cut edges of the material pass. The flow passages, in this embodiment, comprise ramped surfaces 24. As shown most clearly in FIG. 2, the ramped regions 24 on one side of the knife body 10 are out of alignment with those on the other side of the body 10. In addition to being angled in their longitudinal directions the ramped surfaces 24 are also angled in the lateral direction as shown in FIG. 2.

In use, when the knife is to be used to cut a sheet of material, for example to open a bag, sack or other packaging material, the material to be cut is introduced into one of the channels 14, 16. The knife body 10 is then moved relative to the material to be cut to bring the material into contact with the cutting edge 20 of the blade 18, continued movement of the knife body 10 causing the material to be cut. The cut material will enter the ramped regions 24. As the ramped regions 24 on opposing sides of the body 10 are out of alignment with one another, the cut edges are urged apart, in the plane of the material, and away from each other thereby easing continued movement of the knife body 10 relative to the material to be cut, and easing continued cutting of the material. The provision of the lateral sloping of the ramped surfaces 24 further assists in ensuring that the cut edges of the material are moved away from one another. In the orientation illustrated in FIGS. 1 and 2, the movement of the cut material is such that an upper one of the cut edges 26 of the material is moved to the right relative to the cut edge 26 of the lower part of the material. In addition, as the cut edges of the material ride up the ramped surfaces of the ramped regions 24, a degree of vertical separation is also introduced.

Figure 3:
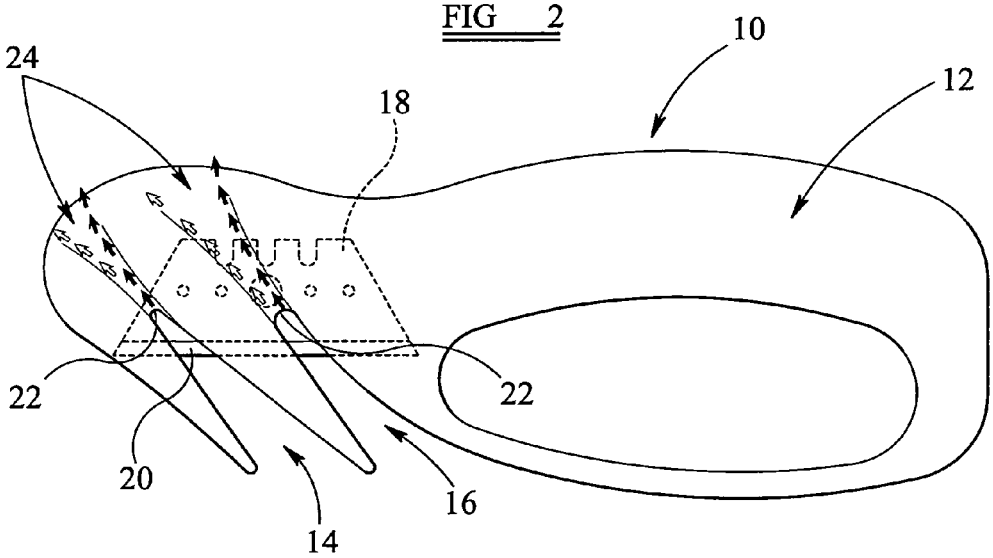
FIG. 3 is a plan view similar to FIG. 1 illustrating an alternative knife design in accordance with an embodiment of the invention.

FIG. 3 illustrates an alternative design of knife which, in many respects, is similar to that shown in FIGS. 1 and 2. In the knife illustrated in FIG. 3, the handle region 12 includes a handle of increased thickness to assist in gripping of the handle region 12. In addition, the channels 14, 16 are both of tapering form to assist in introduction of the material to be cut into the channels 14, 16. Operation of the knife illustrated in FIG. 3 is very similar to that described with reference to FIGS. 1 and 2 and will not be described in further detail.

Figure 4:
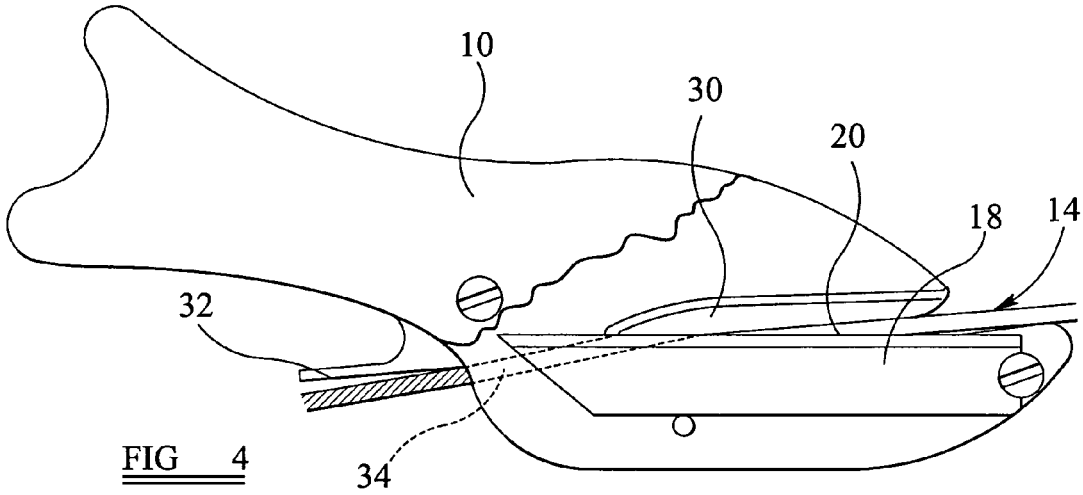
FIG. 4 is a side view, partly broken away, illustrating a further design of knife embodying the invention.
Figure 5:
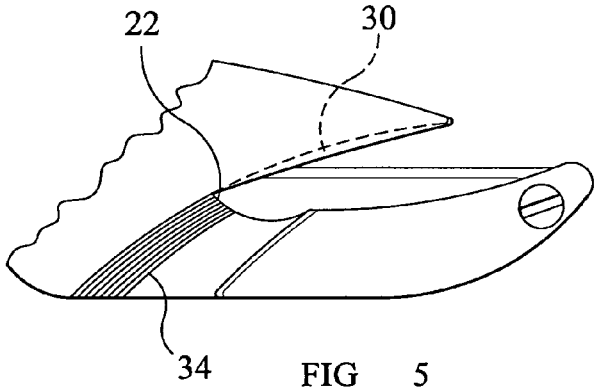
FIGS. 5 and 6 are side views illustrating part of the knife of FIG. 4.
Figure 6:
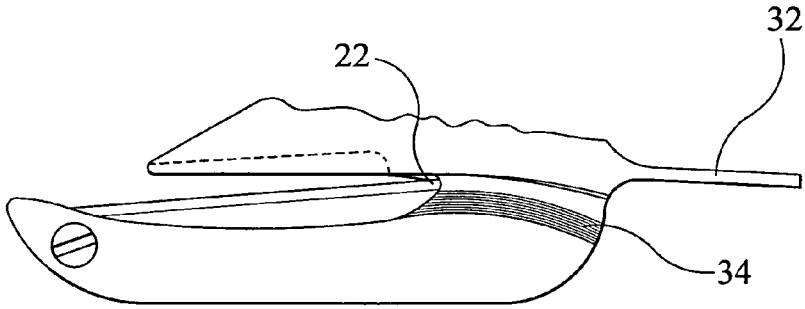

FIGS. 4 to 6 illustrate a third embodiment in accordance with the invention. In this embodiment, the knife includes only a single channel 14 and the cutting edge 20 of the blade 18 extends at a shallow angle to the channel 14. As a result, the blade extends along a significant length of the channel 14 as well as across the width of the channel 14. The knife body 10 is shaped so as to include a recess 30 located opposite the cutting edge 20 into which material to be cut can be pushed.

In accordance with the invention, the knife body 10 is formed with flow passages 34 located adjacent the base region 22 of the channel 14. The passage 34 formed on one side of the knife body 10 is out of alignment with the passage 34 formed on the opposing side of the knife body 10 with the result that the cut material located to one side of the knife body is bent downwardly relative to the cut material located at the other side of the knife body. Such deflection of the cut material assists in allowing the knife to pass through the material with relatively little resistance to movement.

It will be apparent that the knife body 10 of this embodiment does not include a loop handle, and instead a finger guard 32 is provided so as to reduce the risk of the user cutting or grazing his fingers on the cut material.

It will be appreciated that a range of modifications and alterations to the arrangements described hereinbefore may be made within the scope of the invention.

The invention claimed is:

1. A cardboard cutting knife comprising a knife body having an outer surface and a periphery, the knife body housing a blade having opposing faces and a cutting edge, the knife body defining a channel extending inward into the knife body from the periphery thereof and across which extends at least part of the cutting edge of the blade, the channel having a base region located behind the cutting edge and downstream of the cutting edge, the knife body being provided, adjacent the base region, with flow passages on opposing sides thereof, the flow passages extending to the associated exit regions located at the periphery, the flow passages comprising longitudinally and laterally ramped surfaces which extend from the base region adjacent the opposing faces of the blade to the associated exit regions, the flow passage on one side of the body, adjacent one face of the blade, being out of alignment with the flow passage on the other side of the body, adjacent the opposite face of the blade, relative to a plane parallel to the said faces of the blade, such that the exit region of one of the flow passages at the periphery of the knife body is out of alignment with the exit region of the other of the flow passages at the periphery of the knife body, whereby the flow passages, in conjunction with one another, cause a cut edge of material on one side of the blade to be displaced relative to the cut edge on the other side of the blade, wherein the laterally ramped surfaces of the flow passages on opposing sides of the knife body are angled in opposing directions.

2. A knife according to claim 1, wherein the ramping in the lateral direction is of a steeper angle than the ramping in the longitudinal direction.

3. A knife according to claim 1, wherein the knife body defines at least a second channel across which the cutting edge of the blade extends, the knife body being provided with flow passages located adjacent the second channel to deflect the cut edges of the material away from one another.

4. A knife according to claim 1, wherein the cutting edge of the blade extends at a shallow angle to the channel.

* * * * *